US011827327B1

(12) United States Patent
Faust et al.

(10) Patent No.: US 11,827,327 B1
(45) **Date of Patent: *Nov. 28, 2023**

(54) COWLINGS AND LATCHING ASSEMBLIES FOR COWLINGS FOR MARINE DRIVES

(71) Applicant: Brunswick Corporation, Mettawa, IL (US)

(72) Inventors: Devan R. Faust, Fond du Lac, WI (US); Brad J. VanRuiswyk, Waupun, WI (US); Steven J. Amerling, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/092,782

(22) Filed: Jan. 3, 2023

Related U.S. Application Data

(63) Continuation of application No. 16/986,669, filed on Aug. 6, 2020, now Pat. No. 11,577,809.

(51) Int. Cl.

| | |
|---|---|
| ***B63H 20/32*** | (2006.01) |
| ***E05C 3/14*** | (2006.01) |
| ***F02B 61/04*** | (2006.01) |
| ***E05C 19/14*** | (2006.01) |

(52) U.S. Cl.
CPC ..... *B63H 20/32* (2013.01); *E05C 3/14* (2013.01); *E05C 19/14* (2013.01); *F02B 61/045* (2013.01)

(58) Field of Classification Search
CPC . B63H 20/32; E05C 3/14; E05C 19/14; F02B 61/045
See application file for complete search history.

(56) References Cited

U.S. PATENT DOCUMENTS

| | | | |
|---|---|---|---|
| 3,653,237 | A | 4/1972 | Durocher |
| 3,666,305 | A | 5/1972 | Schlichter |
| 3,823,966 | A | 7/1974 | Torii |
| 3,955,526 | A | 5/1976 | Kusche |
| 4,216,984 | A | 8/1980 | Hofmann et al. |
| 4,348,194 | A | 9/1982 | Walsh |

(Continued)

OTHER PUBLICATIONS

Declaration of Prior Art submitted in corresponding U.S. Appl. No. 16/986,938, dated Dec. 17, 2021.

(Continued)

*Primary Examiner* — Stephen P Avila
(74) *Attorney, Agent, or Firm* — ANDRUS INTELLECTUAL PROPERTY LAW, LLP

(57) ABSTRACT

A cowling has first and second cowl portions that enclose a powerhead on a marine drive. A latching assembly is for latching the first and second cowl portions together. The latching assembly has a retainer portion fixed to the first cowl portion and a latching portion fixed to the second cowl portion. The latching portion comprises a latch arm and a bell crank, the latch arm and bell crank being rotatable into and between a latched position in which the latch arm is latched to the retainer portion and an unlatched position in which the latch arm is unlatched from the retainer portion. A novel detent mechanism mechanically retains the latch arm and bell crank in the latched position and alternately in the unlatched position. A pair of bolted connections that fix the first and second cowling portions together and are located on opposite sides of the cowling.

26 Claims, 10 Drawing Sheets

(56) References Cited

U.S. PATENT DOCUMENTS

| | | | | |
|---|---|---|---|---|
| 4,385,341 | A | 5/1983 | Main | |
| 4,600,396 | A | 7/1986 | Crane et al. | |
| 4,723,927 | A | 2/1988 | Walsh et al. | |
| 4,800,854 | A | 1/1989 | Boda et al. | |
| 4,844,031 | A | 7/1989 | Boda et al. | |
| 4,871,333 | A | 10/1989 | Curtis et al. | |
| 4,875,883 | A | 10/1989 | Slattery | |
| 4,878,468 | A | 11/1989 | Boda et al. | |
| 4,886,942 | A | 12/1989 | Lenz et al. | |
| 4,930,790 | A | 6/1990 | Sheridan | |
| 4,932,909 | A | 6/1990 | Curtis et al. | |
| 4,969,847 | A | 11/1990 | Curtis et al. | |
| 5,120,248 | A | 6/1992 | Daleiden et al. | |
| 5,344,338 | A | 9/1994 | Colleran et al. | |
| 5,600,885 | A | 2/1997 | Schroepfer et al. | |
| 6,254,418 | B1 * | 7/2001 | Tharp | H01R 13/6335 439/352 |
| 6,669,517 | B1 | 12/2003 | Alby et al. | |
| 6,682,379 | B1 | 1/2004 | Walczak et al. | |
| 6,991,500 | B1 | 1/2006 | Gulko et al. | |
| 7,201,623 | B1 | 4/2007 | Krupp et al. | |
| 7,267,592 | B1 | 9/2007 | Ingebritson et al. | |
| 9,216,805 | B1 | 12/2015 | Amerling et al. | |
| 9,341,008 | B1 | 5/2016 | Amerling et al. | |
| 9,481,438 | B1 | 11/2016 | Tuchscherer | |
| 9,580,943 | B1 | 2/2017 | Amerling et al. | |
| 9,580,947 | B1 | 2/2017 | Amerling et al. | |
| 9,926,064 | B1 | 3/2018 | Tuchscherer | |
| 10,005,534 | B1 | 6/2018 | Amerling et al. | |
| 10,150,549 | B1 | 12/2018 | Amerling et al. | |
| 10,161,168 | B1 | 12/2018 | VanRuiswyk et al. | |
| 11,577,809 | B1 * | 2/2023 | Faust | F02B 61/045 |
| 2005/0098413 | A1 | 5/2005 | Uehira | |
| 2007/0249244 | A1 | 10/2007 | Watanabe et al. | |
| 2008/0136228 | A1 * | 6/2008 | Friedrich | A47C 7/002 297/217.3 |
| 2015/0047897 | A1 | 2/2015 | Zimet et al. | |
| 2016/0190731 | A1 | 6/2016 | Ting et al. | |
| 2016/0201776 | A1 | 7/2016 | Takase | |

OTHER PUBLICATIONS

Mercury Marine, Electronic Parts Catalog, Top Cowl Cat.# 90-8M0087973, retrieved from https://public-mercurymarine.sysonline.com/Default.aspx?sysname=NorthAmerica&company=Guest&NA_KEY=NA_KEY_VALUE&langIF=eng&langDB=eng, on Dec. 15, 2021.

Mercury Marine, FourStroke 75-150hp, retrieved from https://www.mercurymarine.com/en/US/engines/outboard/fourstroke/75-150hp/, on Dec. 15, 2021.

Southco Latch model No. R4-50-40-101-10, retrieved from https://southco.com/en_us_int/r4-50-40-101-10, on Dec. 15, 2021.

* cited by examiner

COWLINGS AND LATCHING ASSEMBLIES FOR COWLINGS FOR MARINE DRIVES

CROSS REFERENCE TO RELATED APPLICATION

This application is a continuation of U.S. patent application Ser. No. 16/986,669, filed Aug. 6, 2020, which is incorporated herein by reference in its entirety.

FIELD

The present disclosure relates to cowlings for marine drives and to latching assemblies for cowlings for marine drives.

BACKGROUND

The following U.S. Patents are incorporated herein by reference:

U.S. Pat. No. 10,161,168 discloses a latching assembly for a cowl on a marine drive, the cowl having a first cowl portion and a second cowl portion that mates with the first cowl portion. A latching device is configured to latch and unlatch the first cowl portion to the second cowl portion. An actuator actuates the latching device. A flexible connector has a first end coupled to the latching device and a second end coupled to the actuator. Actuation of the actuator pulls the flexible connector to rotate a pulley and actuate the latching device. One of the first and second ends has a spherical bearing that is nested in a cylindrical bearing and seated in a cavity in the pulley. Pulling on the flexible connector pulls the spherical bearing against the cylindrical bearing such that the cylindrical bearing is pulled against the cavity in the pulley, thereby causing the pulley to rotate.

U.S. Pat. No. 10,150,549 discloses a cowling for a marine engine having an outer shell and a supporting structure bonded to an interior surface of the outer shell. The supporting structure has an elongated member that extends along the interior surface and provides rigidity to the outer shell. The supporting structure comprises a plurality of flex joints that are spaced apart along the elongated member and allow the supporting structure to flex transversely to the elongated member and thus follow a contour of the interior surface during bonding to the outer shell. Corresponding methods are disclosed.

U.S. Pat. No. 10,005,534 discloses an assembly for aligning and stabilizing first and second cowl portions on a marine engine. The assembly comprises an engagement member configured to be fixed to the first cowl portion and a retainer portion apparatus configured to be fixed to the second cowl portion. The retainer apparatus is configured to receive the engagement member when one of the first cowl portion and second cowl portion is moved towards the other of the first cowl portion and the second cowl portion. The retainer apparatus comprises a retainer body and opposing guide members that are pivotable with respect to the retainer body. As the retainer apparatus receives the engagement member, the engagement member engages and causes the guide members to pivot with respect to the retainer body such that the engagement member becomes sandwiched between the guide members, thus aligning and stabilizing the first and second cowl portions.

U.S. Pat. No. 9,926,064 discloses a latching apparatus for a cowl on an outboard marine engine. The cowl has a first cowl portion and a second cowl portion, which are latched together by the latching apparatus in a closed cowl position and unlatched from each other in an open cowl position. The latching apparatus comprises a retainer on the first cowl portion; an actuator device on the second cowl portion, and a wire coupled to the actuator device. The wire is coupled to the retainer in the closed cowl position and the wire is uncoupled from the retainer in the open cowl position. Actuation of the actuator device in a first direction rotates the wire so as to couple the wire to the retainer and actuation of the actuator device in a second direction rotates the wire so as to uncouple the wire from the retainer.

U.S. Pat. No. 9,580,947 discloses a cowl for an outboard marine propulsion device having an internal combustion engine. The cowl comprises a first cowl portion; a second cowl portion that mates with the first cowl portion to enclose the internal combustion engine; a service door on the second cowl portion, wherein the service door is positionable in an open position and in a closed position; and a carrying handle on the second cowl portion, wherein the carrying handle is accessible when the service door is in the open position and inaccessible when the service door is in the closed position. A plurality of latches are spaced apart around the perimeter. The latches latch the second cowl portion to the first cowl portion. An actuator assembly actuates each of the plurality of latches. The actuator assembly can be actuated by movement of the carrying handle.

U.S. Pat. No. 9,341,008 discloses a hinge assembly for a cowl of an outboard motor. The hinge assembly is configured to connect a first portion of the cowl to a second portion of the cowl. The hinge assembly comprises an arm that is connected to one of the first and second cowl portions and a retainer that is connected to the other of the first and second cowl portions. The arm is movable with respect to the retainer between a registered position wherein the arm is retained by and pivotable with respect to the retainer to thereby pivotably connect the first portion of the cowl to the second portion of the cowl and an unregistered position wherein the arm is separated from the retainer so that the first portion of the cowl is separated from the second portion of the cowl.

U.S. Pat. No. 7,267,592 discloses a latch mechanism for a cowl of an outboard motor provides a handle and retaining mechanism for the handle which define a detent position when the handle is in a latching or closed position. A protrusion of the handle rotates in a plane which places it between a roller and a metallic ball when the handle is in a latching position. The metallic ball is shaped to be received in a groove formed in the protrusion in order to define the detent position when the handle is in its latched position.

U.S. Pat. No. 4,969,847 discloses a strain relief assembly for an outboard motor for relieving strain on wires, cables, lines or the like which extend between the boat and the cowl assembly which encloses the power head of the outboard motor. The stain relief assembly is preferably disposed within an opening formed in one of the cowl sections, and comprises a two-piece member. The two-piece member includes a series of indentations which cooperate to clamp the wires, cables, lines or the like there between when screwed together. With the strain relief assembly fixed to the wall of the cowl section forming the opening, this acts to maintain the wires, cables or lines in position relative to the cowl section for relieving strain thereon during movement of the outboard motor. A fuel line strain relief assembly is also provided, comprising a stem fixed to the two-piece member. An external fuel line supplies fuel to the stem, which is communicated there through to an internal fuel line extending between the stem and the power head.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

The present disclosure provides a latching assembly for a cowling having first and second cowl portions that enclose a powerhead on a marine drive. A retainer portion is adapted to be fixed to the first cowl portion and a latching portion is adapted to be fixed to the second cowl portion. The latching portion comprises a latch arm and a bell crank, the latch arm and bell crank being rotatable into and between a latched position in which the latch arm is latched to the retainer portion and an unlatched position in which the latch arm is unlatched from the retainer portion. Rotation of the latch arm and bell crank together towards the latched position causes the latch arm to engage the retainer portion, and thereafter further rotation of the bell crank relative to the latch arm causes the latch arm to latch to the retainer portion. Rotation of the bell crank away from the latched position causes the latch arm to unlatch from the retainer portion, and thereafter further rotation of the bell crank relative to the latch arm causes the latch arm to separate from the retainer portion. A novel detent mechanism mechanically retains the latch arm and bell crank in the latched position and alternately in the unlatched position. The cowling further has a pair of bolted connections that fix the first and second cowling portions together. The pair of bolted connections are located on opposite sides of the cowling with respect to each other and with respect to the latch arm and bell crank.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
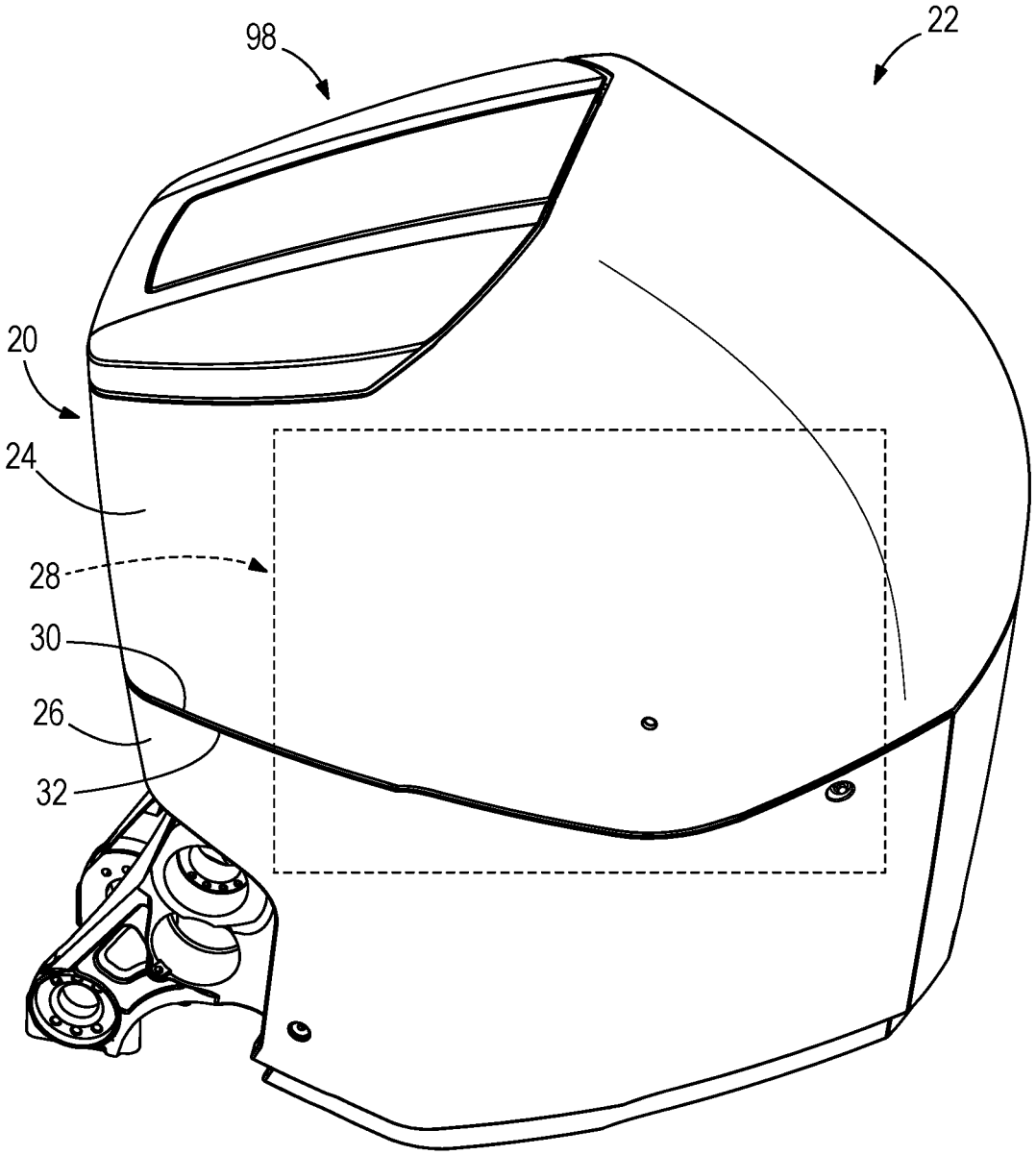
FIG. 1 is an exterior perspective view of a cowling for an outboard motor, the cowling having top and bottom cowl portions that together enclose a powerhead.
Figure 2:
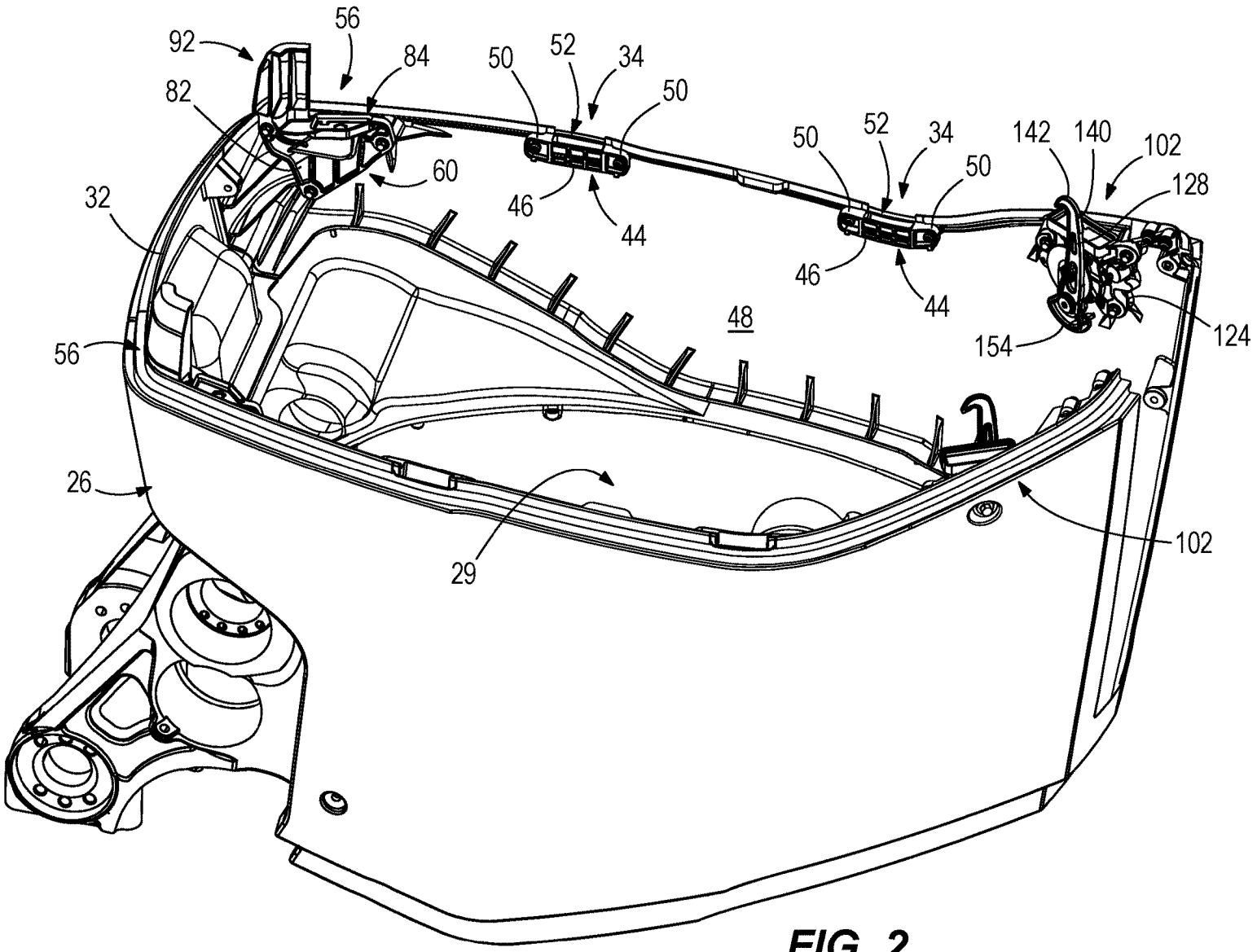
FIG. 2 is a perspective view of the bottom cowl portion.
Figure 3:
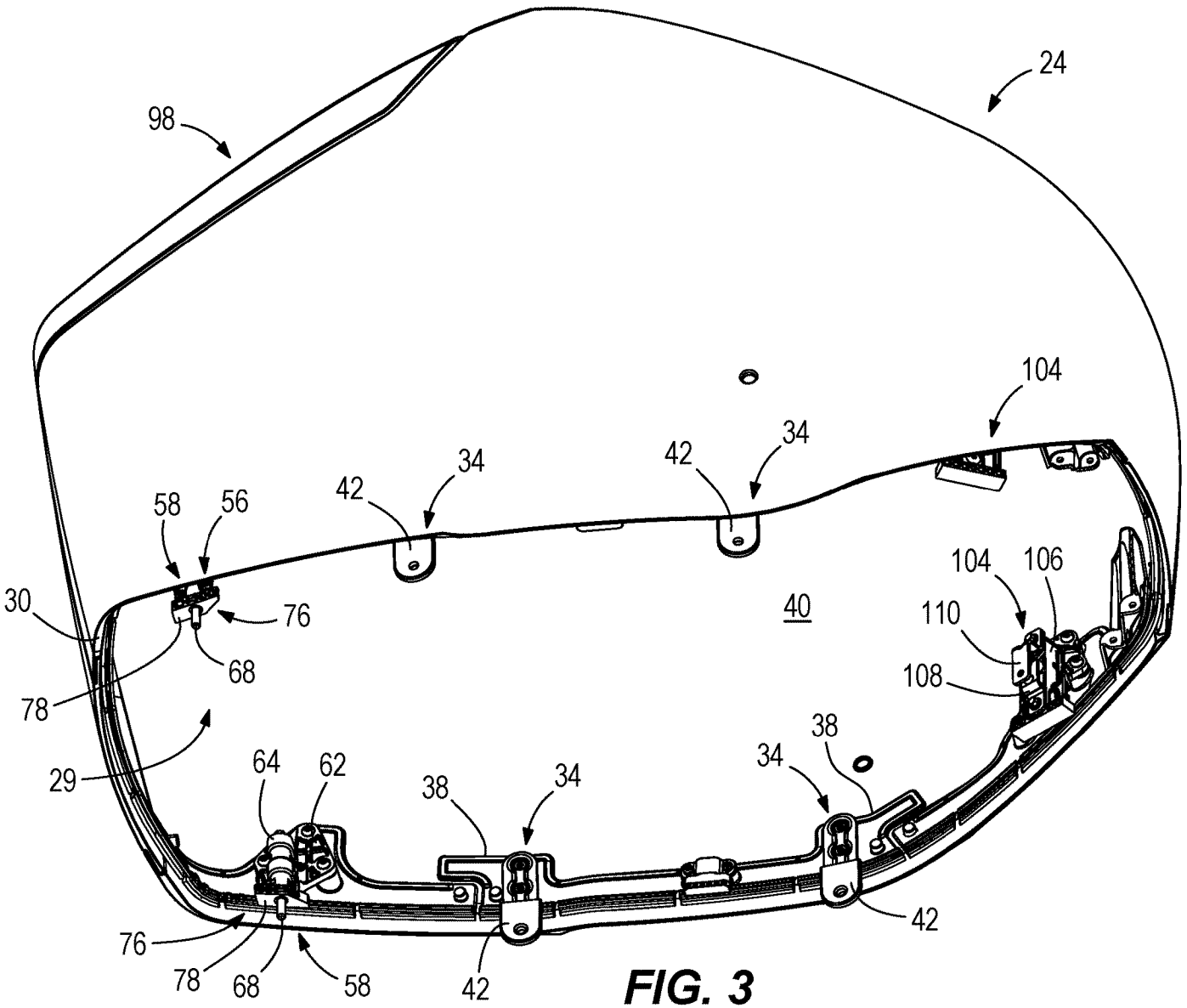
FIG. 3 is a perspective view of the top cowl portion.
Figure 4:
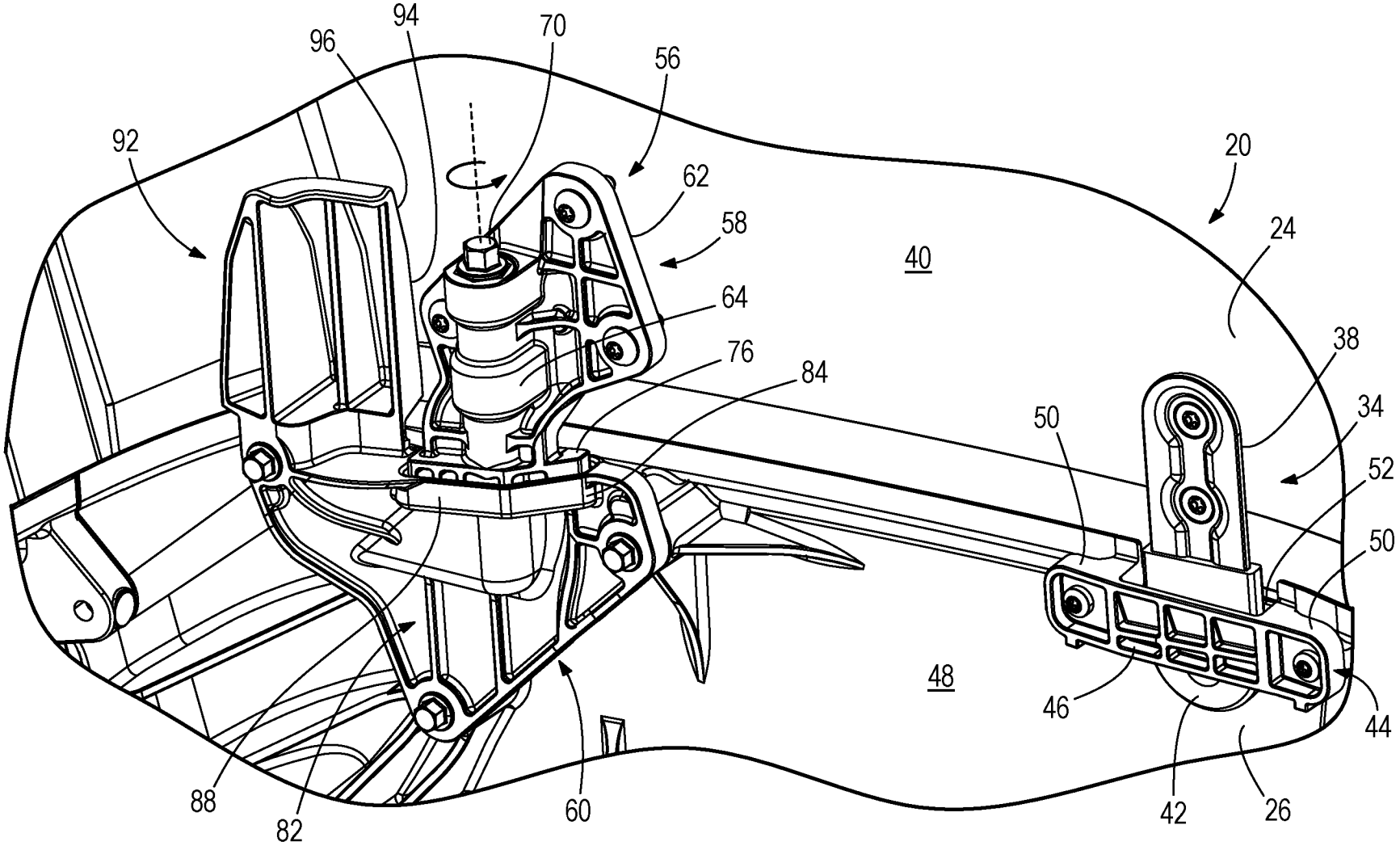
FIG. 4 is an interior perspective view of the top and bottom cowl portions in a closed cowl position, wherein the top cowl is fixed to the bottom cowl by a bolted connection.

FIG. 1 depicts a cowling 20 for a marine drive, which in the illustrated embodiment is an outboard motor 22. The type and configuration of the marine drive can vary from what is shown. In the illustrated example, the cowling 20 has a first, top cowl portion 24 and a second, bottom cowl portion 26. Together, the top and bottom cowl portions 24, 26 enclose a powerhead 28, which is schematically depicted and for example can include an internal combustion engine and/or any conventional means for providing a force for propelling the associated marine vessel in water. FIGS. 1 and 4 depict the cowling 20 in a closed cowl position, wherein the top cowl portion 24 and bottom cowl portion 26 are brought together and enclose the powerhead 28 within a cowling interior 29. FIGS. 2 and 3 are isolated views of the top and bottom cowl portions 24, 26, respectively. In the closed cowl position, the top cowl portion 24 extends around and over the top of the powerhead 28 and the bottom cowl portion 26 extends around the sides of and beneath the powerhead 28. The top and bottom cowl portions 24, 26 have perimeter edges 30, 32, respectively, that extend around the respective top and bottom cowl portions 24, 26, and that are aligned and face each other when the top cowl portion 24 is mounted onto the bottom cowl portion 26 into the closed cowl position. Optionally a rubber seal or other type of seal can be located along one or both of the perimeter edges 30, 32 and in particular configured to form a watertight seal between the top and bottom cowl portions 24, 26. One example of a suitable sealing configuration is disclosed in the presently incorporated U.S. Pat. No. 10,150,549. For the purposes of the present invention, the shape and basic configuration of the cowling 20 can vary from what is shown.

Optionally, the cowling 20 has several alignment mechanisms 34 located along the perimeter edges 30, 32. The alignment mechanisms 34 are configured to facilitate proper alignment of the perimeter edges 30, 32 with each other when the top cowl portion 24 is manually lowered onto the bottom cowl portion 26. Referring to FIG. 3, each alignment mechanism 34 includes a body 38 fixed to an interior wall 40 of the top cowl portion 24, for example via fasteners. The body 38 is located proximate to the perimeter edge 30. An engagement tab 42 extends downwardly from the body 38 and past the perimeter edge 30. Referring to FIG. 2, the alignment mechanism 34 further includes a base bracket 44 having a body 46 fixed to an interior wall 48 of the bottom cowl portion 26. More specifically, the body 46 has opposing ends 50 that are fixed to the interior wall 48 for example via fasteners. The body 46 is located proximate to the perimeter edge 32. A receiving slot 52 is defined between the body 46 and the interior wall 48. Referring to FIG. 4, the receiving slot 52 is sized to receive and guide the engagement tab 42 between the body 46 and the interior wall 48 of the bottom cowl portion 26 when the top cowl portion 24 is manually lowered onto the bottom cowl portion 26, and thereby to facilitate proper alignment of the perimeter edges 30, 32. In the illustrated example, the cowling 20 has four alignment mechanisms 34 located along the perimeter edges 30, 32, and particularly has two alignment mechanisms 34 that are spaced apart from each other and located along each opposing side of the cowling 20, in particular along the port and starboard sides. The number, location and configuration of the alignment mechanisms 34 can vary from what is shown. Optionally, one or more of the alignment mechanisms 34 can be configured in the manner disclosed in the above-incorporated U.S. Pat. No. 10,005,534, in particular having features that further guide or funnel the noted engagement tab 42 into a seated position within the receiving slot 52.

Figure 5:
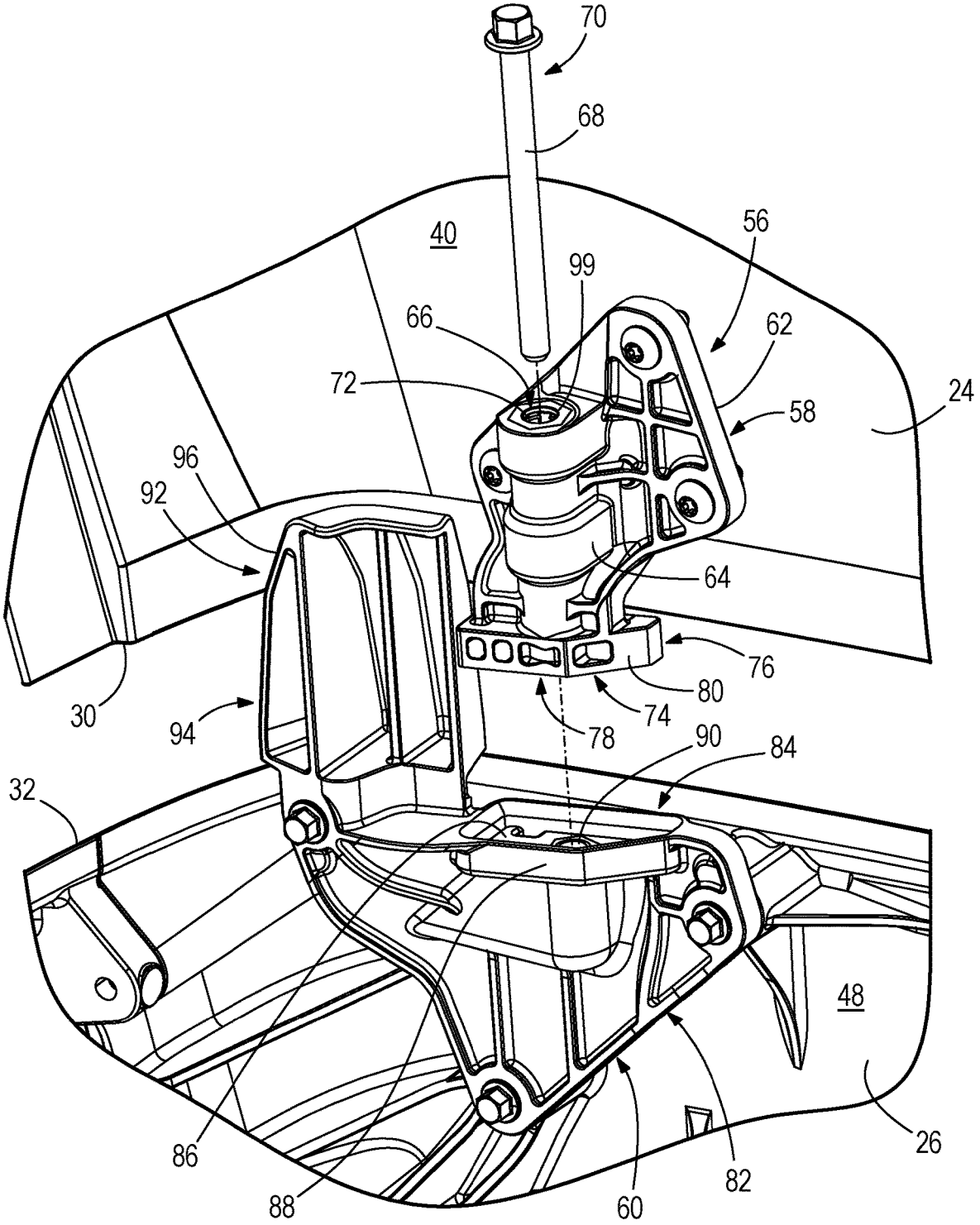
FIG. 5 is an exploded view of the bolted connection.

Referring to FIGS. 2-4, a pair of bolted connections 56 are configured to fix the top and bottom cowl portions 24, 26 together in the closed cowl position. The bolted connections 56 are located on opposite sides of the cowling 20, in particular towards the front of the outboard motor 22 on the port and starboard sides. Each bolted connection 56 has a first, upper mounting bracket 58 fixed to the top cowl portion 24 near the perimeter edge 30 and a second, lower mounting bracket 60 fixed to the bottom cowl portion 26 near the perimeter edge 32. Referring to FIGS. 4 and 5, the upper mounting bracket 58 has a base 62 that faces and is fixed to the interior wall 40 of the top cowl portion 24, by for example fasteners. A body 64 on the base 62 defines a through-bore 66 for receiving the shaft 68 of a fastening bolt 70. The through-bore 66 has an upper receiving end 72 that receives the shaft 68 during installation and a lower end 74 through which the shaft 68 extends upon installation. A pedestal 76 extends downwardly from the body 64, past the perimeter edge 30, as shown in FIG. 5. The pedestal 76 has a planar base surface 78 and outer perimeter surfaces 80, most of which are angular with respect to each other and thus together generally form a trapezoidal shape.

The lower mounting bracket 60 has a base 82 that faces and is fixed to the interior wall 48 of the bottom cowl portion 26, alongside the perimeter edge 32. A receiving tray 84 protrudes from the base 82, and particularly extends radially inwardly towards the cowling interior 29. The receiving tray 84 has a floor 86 and sidewalls 88 that surround and extend upwardly from the floor 86. The sidewalls 88 form a trapezoidal shape that corresponds to, but is slightly larger than the trapezoidal shape of the pedestal 76. A threaded bore 90 in the floor 86 is configured to receive the shaft 68 of the fastening bolt 70 in a threaded connection. An alignment wall 92 extends upwardly from the base 82, adjacent to the receiving tray 84 and particularly upwardly past the perimeter edge 32, as shown in FIG. 5. The alignment wall 92 has a generally planar lower outer surface 94 and a generally planar upper outer surface 96 that is angled inwardly with respect to the lower outer surface 94 so as to provide a beveled guide surface, as will be further explained herein below.

During installation, the top cowl portion 24 is manually lowered over the powerhead 28 and onto the bottom cowl portion 26. During this process, the installer will try to generally align the perimeter edge 30 of the top cowl portion 24 with the perimeter edge 32 of the bottom cowl portion 26, and in an orientation wherein the pedestal 76 is engaged in the receiving tray 84. Advantageously, the alignment walls 92 of the opposing bolted connections 56 are specially configured such that the perimeter edge 30 of the top cowl portion 24 engages with the above-noted beveled guide surface. Upon such engagement, the perimeter edge 32 is safely guided downwardly alongside the upper and lower outer surfaces 96, 94, helping ensure proper alignment between the perimeter edges 30, 32 and thus facilitating proper seating of the pedestal 76 in the receiving tray 84. As explained herein above, the alignment mechanisms 34 can also be provided to further properly align the perimeter edges 30, 32 during installation.

Once the top cowl portion 24 is fully lowered onto the bottom cowl portion 26, bolted connections 56 are manually accessible via an access door 98 in the top cowl portion 24. The access door 98 is for example pivotally connected to the top cowl portion 24 via a hinge (not shown). However the type of connection between the access door 98 and the top cowl portion 24 can vary, and can be any conventional connection that facilitates opening and closing of the access door 98 with respect to the top cowl portion 24. Opening the access door 98 exposes the cowling interior 29 and thus provides manual access to the bolted connections 56. Also, since the top cowl portion 24 has been properly aligned with the bottom cowl portion 26, as explained herein above, the pedestal 76 is already properly seated in the receiving tray 84, which automatically aligns the through-bore 66 with the bore 90 in the floor 86 of the receiving tray 84. Thus, the installer is able to easily manually insert the fastening bolt 70 into the through-bore 66 and further into threaded engagement with the bore 90, thereby fixing the top cowl portion 24 to the bottom cowl portion 26 in a relatively simple operation. A rubber retention grommet 99 can be provided in the through-bore 66 and configured to retain the fastening bolt 70 between uses, such that the fastening bolt 70 does not accidentally get dropped into the cowling interior 29 and/or otherwise lost. Once the bolted connections 56 are secured, the access door 98 can be closed, thus fully enclosing the powerhead 28 in the cowl interior 29.

Referring to FIGS. 6-11, the cowling 20 also includes a novel latching assembly 100 for latching the top cowl portion 24 to the bottom cowl portion 26 once the bolted connections 56 are made, as explained herein above. The latching assembly 100 includes a pair of latching devices 102 located on opposite sides of the cowling 20, in particular on rearward side of outboard motor 22, and on the port and starboard sides of the cowling 20. The latching devices 102 are advantageously located on the rearward side of the outboard motor 22 for easier access by the installer from outside of the outboard motor 22, for example when it's stored in a mounted position on the marine vessel. The bolted connections 56 are located on the forward side of the outboard motor 22. The configuration and location of the latching devices 102 can vary from what is shown.

The latching devices 102 are each configured in a somewhat similar manner to the latching devices disclosed in the presently incorporated U.S. Pat. Nos. 9,926,064 and 10,161,168. However the latching devices 102 differ from this prior art, in particular that the latching devices 102 include a novel detent mechanism, for automatically retaining the latching devices 102 in the latched and unlatched positions, as will be further explained herein below.

Referring to FIGS. 6-11, each latching device 102 has a retainer portion 104 which is affixed to the interior wall 40 of the top cowl portion 24 and a latching portion 122, which is affixed to the interior wall 48 of the bottom cowl portion 26. The retainer portion 104 has a base plate 106 and a mounting block 108 on the base plate 106. The base plate 106 and mounting block 108 can be formed together or as separate components. A mounting bracket 110 extends inwardly towards the cowl interior 29 from the mounting block 108 and includes a pair of aligned offset bracket portions 114, 116. A supporting shaft 118 extends between the pair of aligned offset bracket portions 114, 116 such that a gap 170 (see FIG. 7) exists there between. As will be further described herein below, the gap 170 allows for a latch arm on the respective latching device 102 to rotate into initial engagement with the supporting shaft 118, and also to translate into and out of latching engagement with the supporting shaft 118, and vice versa. The location and configuration of the retainer portion 104 can vary from what is shown.

The latching portion 122 includes a latch housing 124, a latch arm 128 and a bell crank 130. The latch housing 124 has a series of through-bores through which suitable fasteners are inserted into corresponding mounting holes on the interior wall 48 of the bottom cowl portion 26, thereby fixing the latch housing 124 to the bottom cowl portion 26. The latch arm 128 is rotatable and translatable with respect to the latch housing 124 and with respect to the corresponding retainer portion 104, into and between a latched position (see FIGS. 6 and 7) in which a hook end 142 of the latch arm 128 engages with the supporting shaft 118 of the retainer portion 104 so as to retain the top and bottom cowl portions 24, 26 in the closed cowl position, and an unlatched position (see FIG. 11) in which the latch arm 128 is disengaged from the supporting shaft 118 to allow removal of the top cowl portion 24 from the bottom cowl portion 26.

The bell crank 130 causes rotation of the latch arm 128 and helps enact an over-center force that assists translational movement of the latch arm 128 into and out of the latched and unlatched positions. A torsion spring (not shown) has a first end located between the latch arm 128 and bell crank 130 connected to the latch arm 128 and a second end connected to the bell crank 130, as described in the above-incorporated patents. The torsion spring has a natural resiliency that tends to retain the bell crank 130 and latch arm 128 in a consistent rotational position with respect to each other, for example when the latching portion 122 is in the unlatched position. Rotational movement of the bell crank 130 with respect to the latch arm 128 tensions the torsion spring. It should be noted that the concepts herein disclosed are not limited to arrangements having a torsion spring. For example, a coil spring could instead be used.

Figure 7:
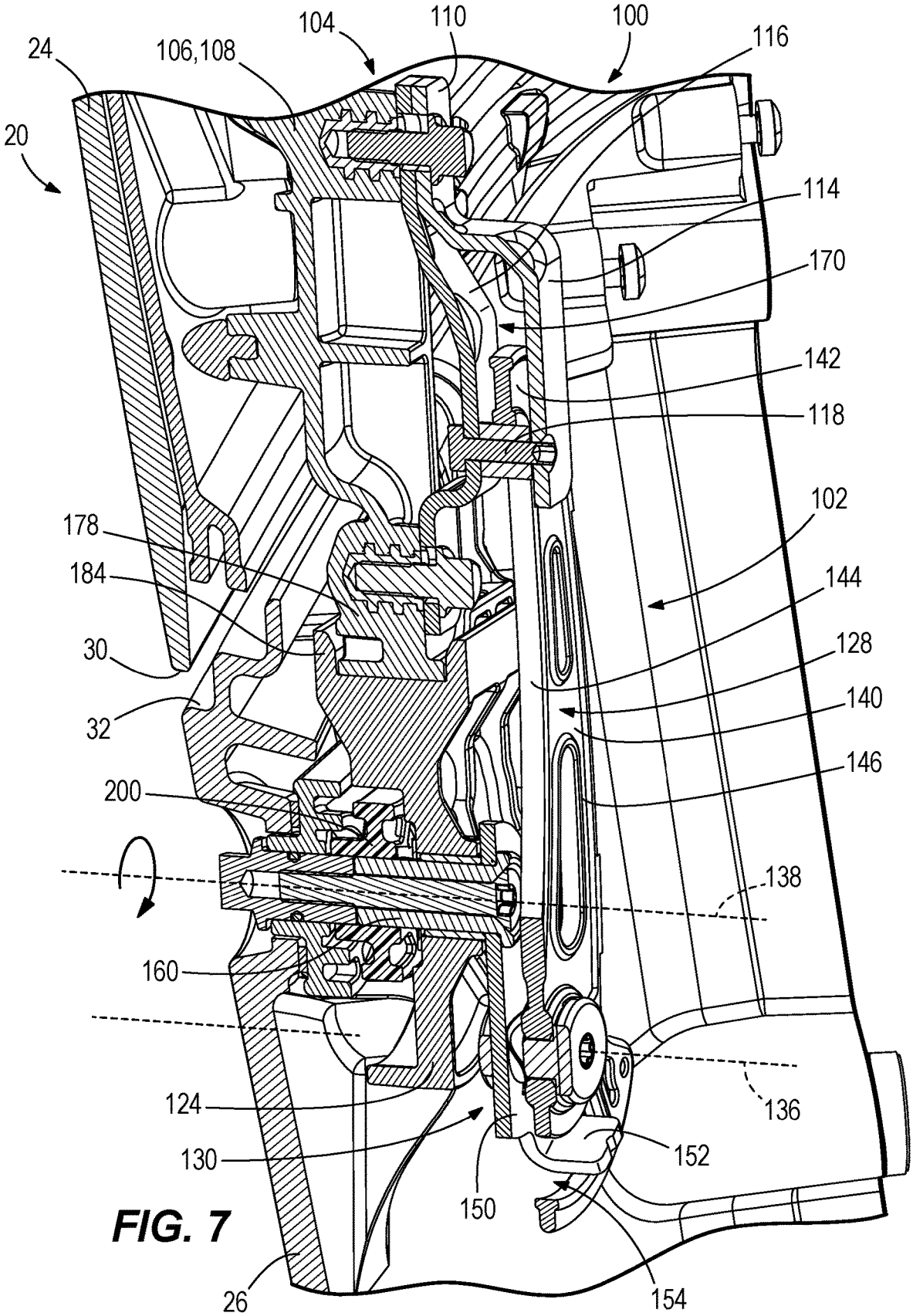
FIG. 7 is a view of section 7-7, taken in FIG. 6.

Referring to FIG. 7, the latch arm 128 is rotatable about a latch arm axis of rotation 136. The bell crank 130 is rotatable about a bell crank axis of rotation 138. At certain points, as further described herein below, the latch arm 128 is caused to translate with respect to the bell crank axis of rotation 138 as the bell crank 130 is rotated about the bell crank axis of rotation 138. The latch arm axis of rotation 136 and the bell crank axis of rotation 138 are parallel to each other and are laterally spaced apart from each other. The latch arm 128 has an elongated body 140 having a hook end 142 that engages with the supporting shaft 118 in the latched position, as will be further described herein below. The elongated body 140 has opposing first and second engagement surfaces 144, 146, and the hook end 142 has a curved inner engagement surface 148 that generally transversely extends relative to the first engagement surface 144.

The bell crank 130 has a base plate 150 and an engagement projection 152 that extends into an engagement slot 154 located on the opposite end of the elongated body 140 relative to the hook end 142. The elongated body 140 is rotatably coupled to the base plate 150 via a stub shaft 155 and an axle pin 157 that extends through the elongated body 140 and into engagement with the stub shaft 155. The engagement projection 152 rotationally engages with and causes rotation of the latch arm 128 as the bell crank 130 is rotated about the bell crank axis of rotation 138, and in particular when the bell crank 130 is caused to rotate with respect to the latch arm 128. Engagement between the bell crank 130 and the latch arm 128 occurs upon rotation of the bell crank 130 in the unlatching direction and in the latching direction. The configuration of the latch arm 128 and bell crank 130 can vary from that which is shown.

Figure 8:
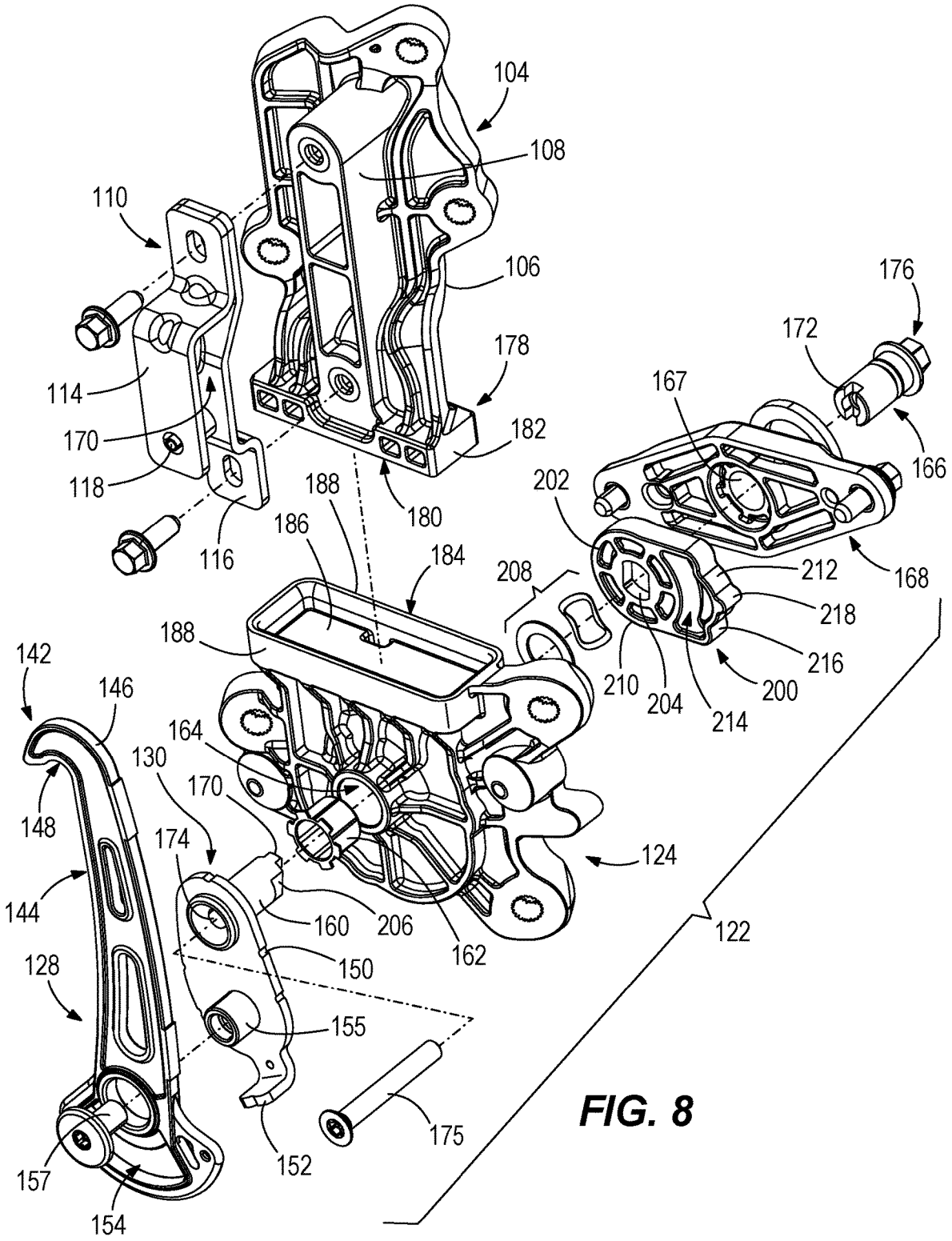
FIG. 8 is an exploded perspective view of the latching assembly.

Referring to FIGS. 7 and 8, the bell crank 130 is rotatable with respect to the latch housing 124 as follows. A stub shaft 160 extends from the base plate 150 of the bell crank 130, into the front of the latch housing 124, and particularly into a bearing sleeve 162 disposed in a through-bore 164 in the latch housing 124. The bearing sleeve 162 facilitates rotation of the stub shaft 160 relative to the latch housing 124. A hex actuator arm 166 extends into the through-bore 164 from the rear of the latch housing 124, and particularly through a through-bore 167 in a backing bracket 168 affixed to the rear of the latch housing 124. The stub shaft 160 has an outer end 170 that is keyed to an outer end 172 of a hex actuator arm 166, such that rotation of the hex actuator arm 166 causes rotation of the stub shaft 160 and corresponding base plate 150. A fastener 175 extends through a through-bore 174 in the base plate 150 and stub shaft 160 and further into engagement with the hex actuator arm 166, thus axially securing the bell crank 130 and hex actuator arm 166 with respect to each other.

The hex actuator arm 166 thus extends along the bell crank axis of rotation 138. The hex actuator arm 166 has a hex-shaped head 176 configured for engagement by a rotary tool, such as a wrench. Referring to FIG. 1, the hex actuator arm 166 extends through a through-bore in the bottom cowl portion 26 and the hex-shaped head 176 is accessible from outside of the cowling 20. Thus, the latching portion 122 can be manually actuated by the installer via a wrench after the bolted connections 56 are installed and the cowling 20 is in the closed cowl position. Manual rotation of the hex actuator arm 166 rotates the bell crank 130 and further rotates the latch arm 128, as further described herein below.

Referring to FIG. 8, the retainer portion 104 further has a mounting pedestal 178 which extends downwardly from the base plate 106, and particularly downwardly past the perimeter edge 32 of the top cowl portion 24. The mounting pedestal 178 has a bottom surface 180 and sidewalls 182 that extend around the bottom surface 180 to as to form a generally rectangular shape. The latch housing 124 has a receiving tray 184 that faces upwardly and is configured to receive the mounting pedestal 178 in a seated arrangement. The receiving tray 184 has a floor 186 and perimeter sidewalls 188 that together define a generally rectangular shape that corresponds to but is sized slightly larger than the rectangular shape of the mounting pedestal 178. When the top cowl portion 24 is manually lowered onto the bottom cowl portion 26, as described herein above, the above-described alignment features, including the alignment walls 92 of the opposing bolted connections 56 and the optional alignment mechanisms 34 facilitate proper alignment of the perimeter edges 30, 32, thus also causing the mounting pedestal 178 to properly seat in the receiving tray 184. Nesting of the mounting pedestal 178 in the receiving tray 184 properly positions the retainer portion 104 and particularly its supporting shaft 118 location for subsequent latching engagement by the latch arm 128 during the latching process, as will be further described herein below.

As will be apparent from the below-description, and as more fully described in the presently incorporated U.S. Pat. No. 9,580,947, latch arm 128 and bell crank 130 are specially configured such that rotation of the bell crank 130 with respect to the latch arm 128 creates an over-center force on the latch arm 128 that advantageously assists movement of the latch arm 128 into and out of the unlatched and latched positions.

Once the bolted connections 56 are installed, as described herein above, the installer can latch each respective latching device 102 by rotating the hex actuator arm 166 in a latching direction, particularly by engaging and rotating the hex-shaped head 176 with a tool. Rotation of the hex actuator arm 166 in the latching direction rotates the bell crank 130 in the latching direction, which also causes rotation of the latch arm 128 because as explained above, the bell crank 130 and latch arm 128 are rotationally biased together by the torsion spring. That is, the latch arm 128 and bell crank 130 initially rotate together, due to the resiliency of the torsion spring retaining the bell crank 130 and latch arm 128 in the orientation shown in FIG. 11. Rotation of these items continues until the first engagement surface 144 of the elongated body 140 engages the supporting shaft 118. Continued rotation of the bell crank 130 in the latching direction causes the bell crank 130 to rotate relative to the latch arm 128. Continued rotation of the bell crank 130 causes the elongated body 140 to translate downwardly relative to the supporting shaft 118 as the first engagement surface 144 slides along the supporting shaft 118, and until the inner engagement surface 148 engages in a latching connection with the supporting shaft 118, thus latching the top cowl portion 24 to the bottom cowl portion 26. The bell crank 130 continues to rotate relative to the latch arm 128 until the engagement projection 152 reaches the end of the engagement slot 154, which provides a stop. Rotation of the bell crank 130 relative to the latch arm 128 and engagement between the engagement projection 152 and the latch arm 128 creates an over-center force that assists movement of the latch arm 128 into the latched position. Refer to U.S. Pat. No. 9,580,947 for further description.

Conversely, engaging and rotating the hex actuator arm 166 in the opposite, unlatching direction rotates the bell crank 130 in the opposite unlatching direction, which initially causes the inner engagement surface 148 to separate from the supporting shaft 118 while the first engagement surface 144 is caused to slide upwardly along but continue to abut the supporting shaft 118. Subsequent continued rotation of the bell crank 130 in the unlatching direction causes the engagement projection 152 to engage an opposite end of the engagement slot 154 in the latch arm 128, thus causing the latch arm 128 to rotate away from the supporting shaft 118, about the bell crank axis of rotation 138 until the latching portion 122 is in the unlatched position shown in FIG. 11. As mentioned above, in the unlatched position, the resiliency of the torsion spring tends to maintain relative positions of the bell crank 130 and latch arm 128.

Figure 6:
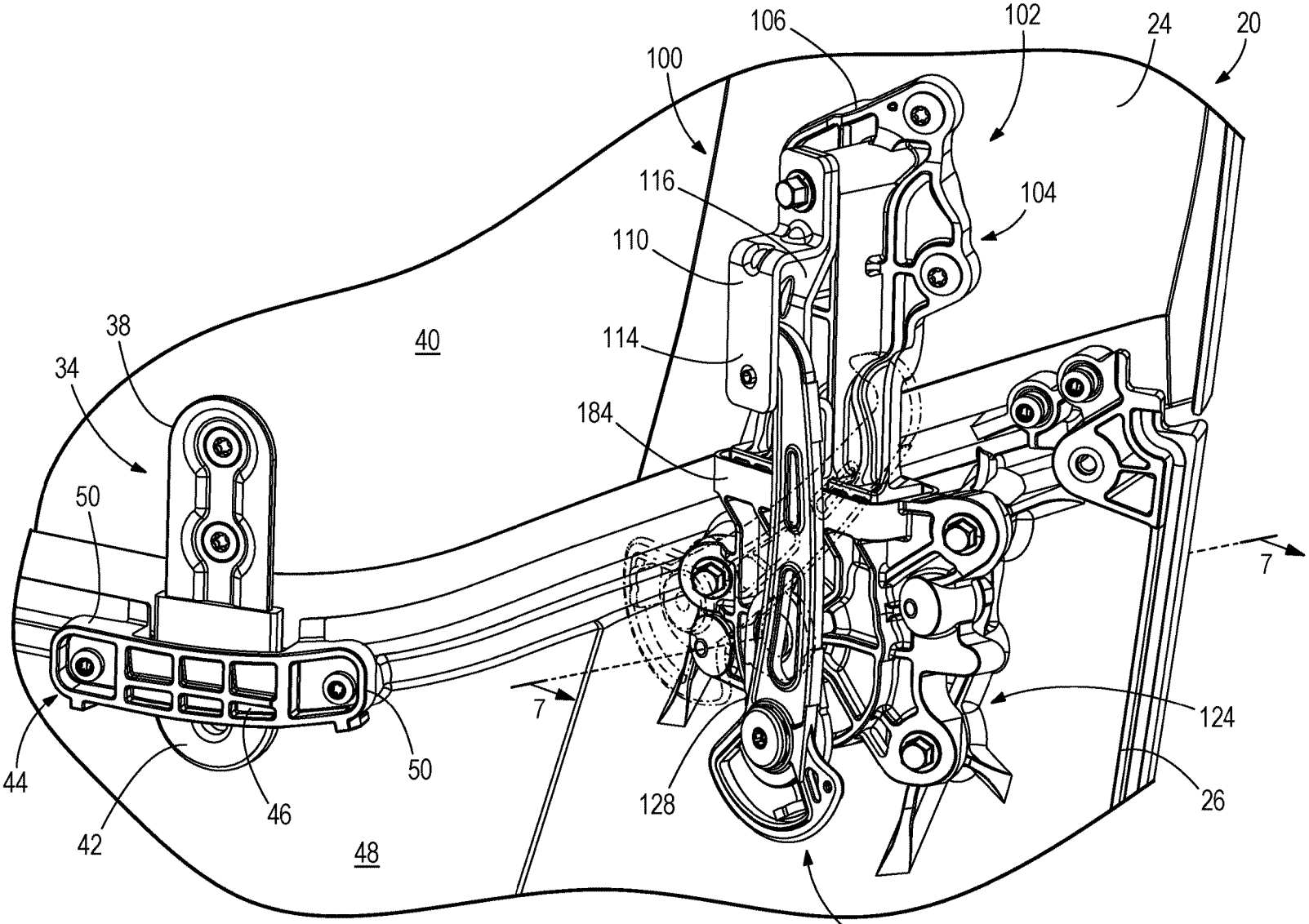
FIG. 6 is an interior perspective view of the top and bottom cowl portions in the closed cowl position, wherein the top cowl is latched to the bottom cowl by a latching assembly.

Referring to FIGS. 8-11, each latching device 102 has a detent mechanism 200 that mechanically retains the latch arm 128 and the bell crank 130 in the latched position shown in solid lines in FIG. 6 and the unlatched positon shown in dashed lines in FIG. 6. Referring to FIG. 8, the detent mechanism 200 includes a detent body 202 that is coupled to and rotates with the stub shaft 160 and hex actuator arm 166 about the bell crank axis of rotation 138. In particular, the detent body 202 has a non-circular through-bore 204 through which the stub shaft 160 extends. Flats 206 on the outer circumference of the stub shaft 160 are engaged with sides of the through-bore 204 so that rotation of the stub shaft 160 causes rotation of the detent body 202 about the bell crank axis of rotation 138. The detent body 202 is located axially between the rear surface of the latch housing 124 and a front surface of the backing bracket 168. A washer and Belleville spring 208 are disposed on the stub shaft 160 between the detent body 202 and the rear surface of the latch housing 124. The washer and Belleville spring 208 axially bias the detent body 202 away from the rear surface of the latch housing 124 and facilitate rotation of the detent body 202 relative to the latch housing 124 about the bell crank axis of rotation 138.

Referring to FIG. 8, the detent body 202 is for example made of plastic and includes a central hub 210 and a radially outer band 212 that extends along a perimeter of the central hub 210 and has a center portion that is separated from the central hub 210 such that a gap 214 is defined between the central hub 210 and the radially outer band 212. The radially outer band 212 is radially flexible towards and away from the central hub 210, i.e., into and back out of the gap 214. It will thus be understood that a radial compression force applied on the radially outer band 212 will tend to bend the central portion of the radially outer band 212 into the gap 214. Releasing the compression force will allow the radially outer band 212 to spring back out of the gap 214 to its original position, under force of its own natural resiliency. The radially outer band 212 has an outer perimeter surface 216 and an engagement member 218 on the outer perimeter surface 216, which in the illustrated example is a protruding portion of the radially outer band 212, herein after referred to as radial protrusion 218. The radial protrusion 218 is thus flexible along with the rest of the radially outer band 212, towards and away from the central hub 210, as described herein above.

Figure 9:
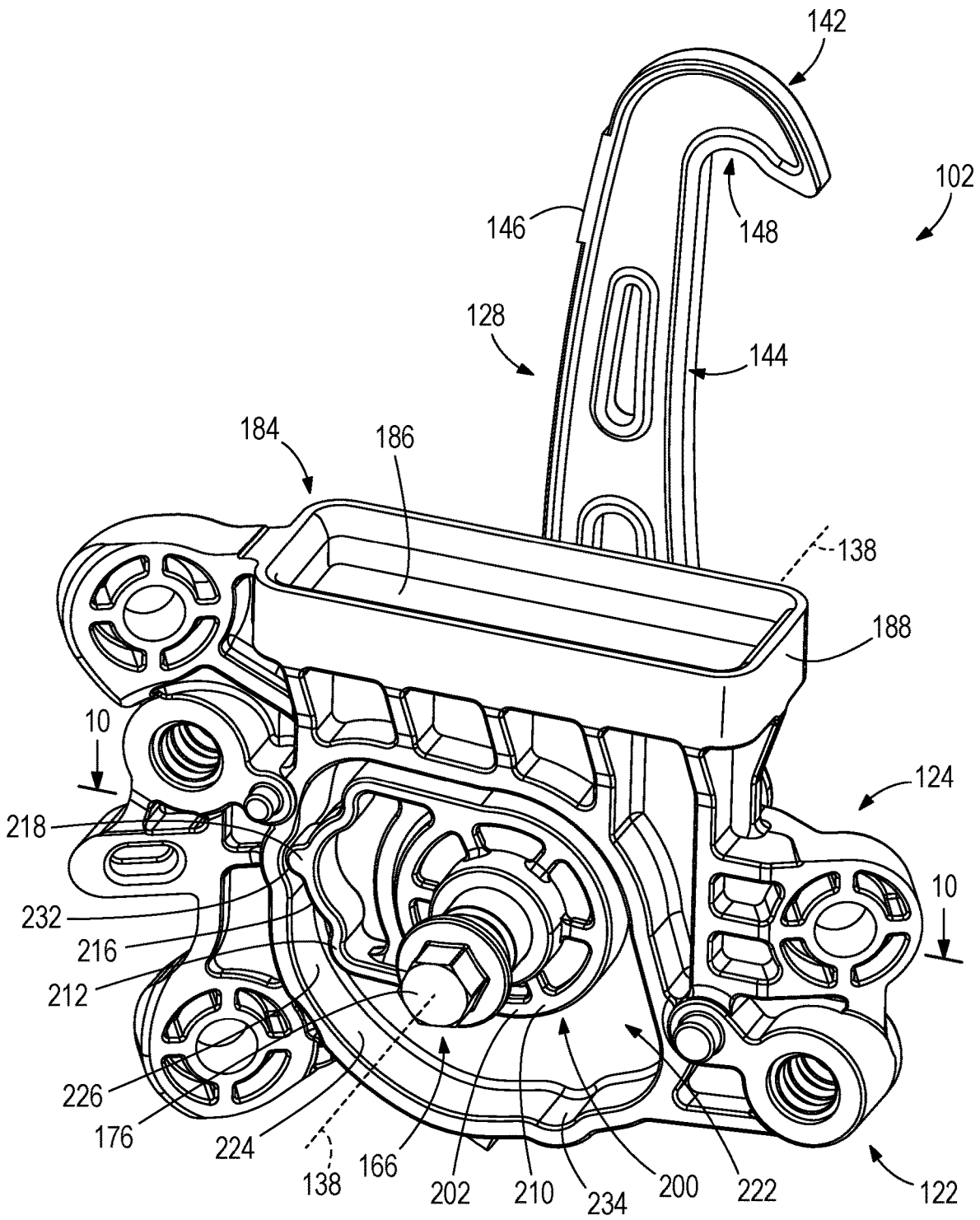
FIG. 9 is a perspective view of an inner side of the latching assembly, showing a novel detent mechanism for retaining the latching assembly in a latched position and alternately in an unlatched position.
Figure 10:
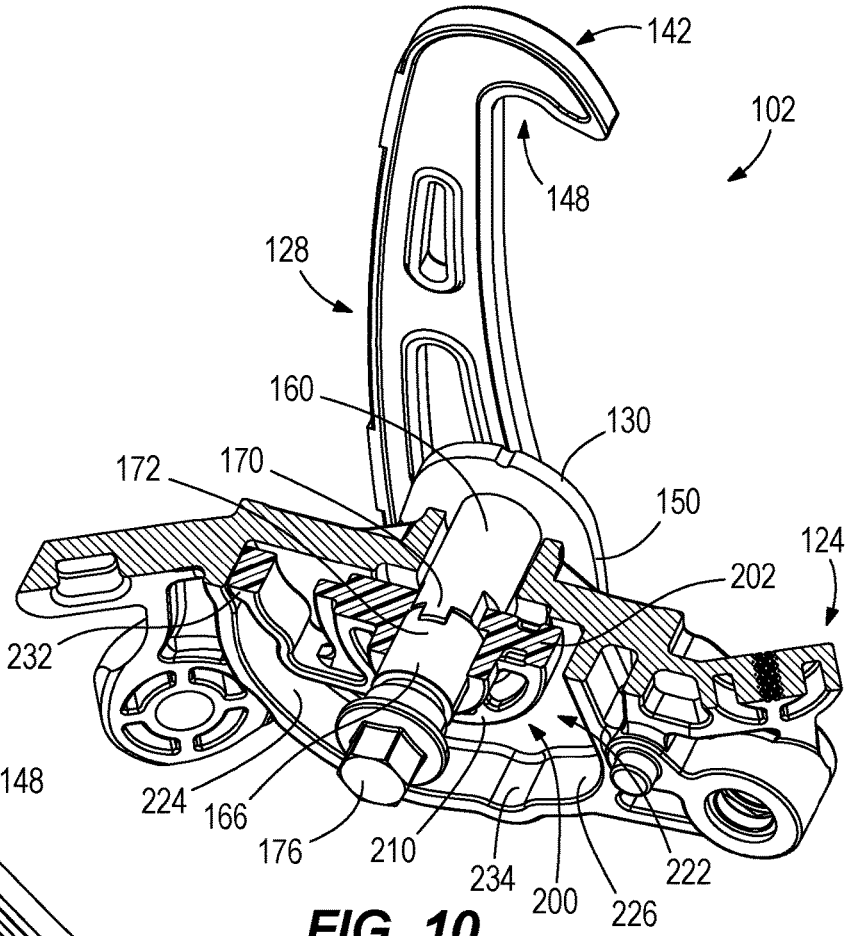
FIG. 10 is a view of section 10-10, taken in FIG. 9.
Figure 11:
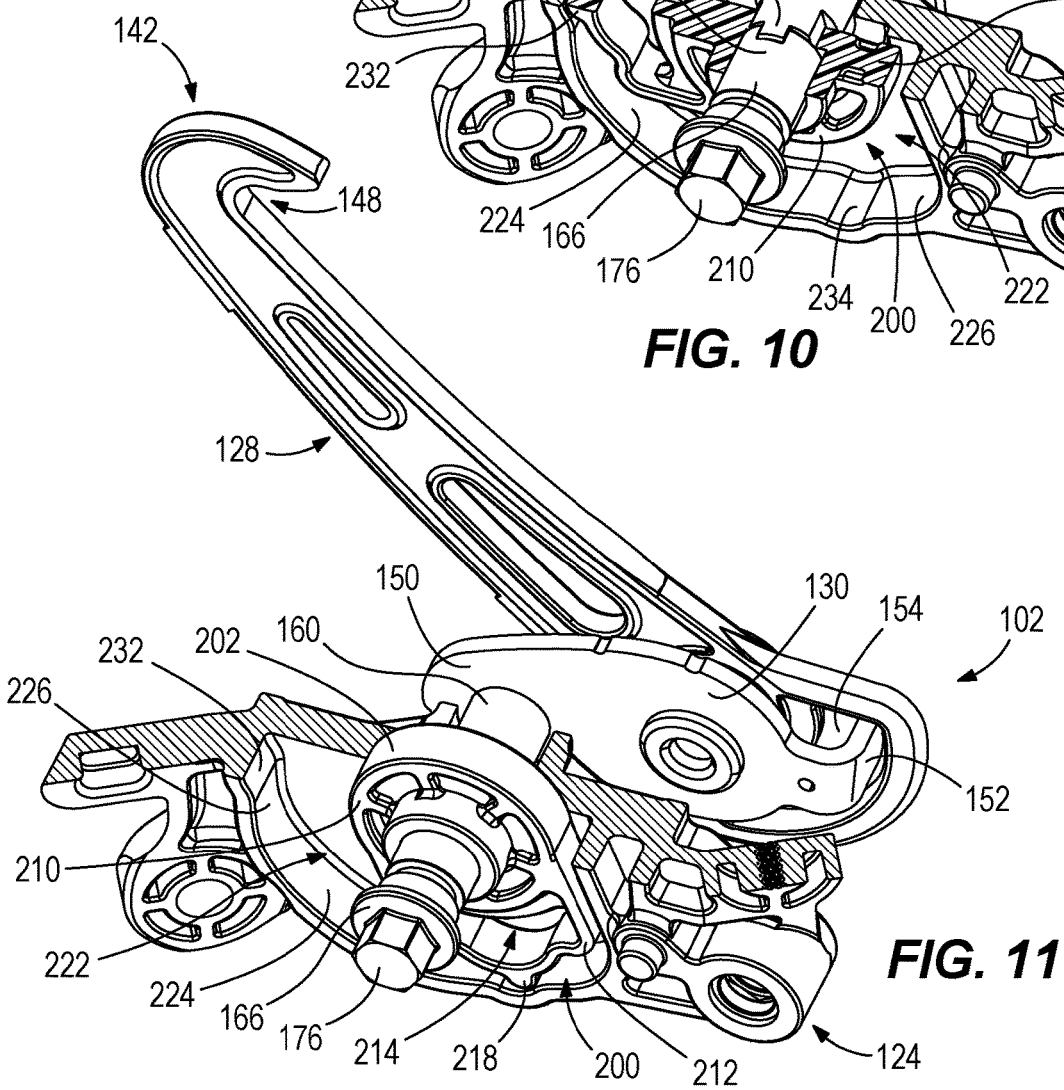
FIG. 11 is a view like FIG. 10, showing the latching portion in the unlatched position.

Referring to FIG. 9, the detent body 202 is located in a cavity 222 in the rear of the latch housing 124. The cavity 222 has a sidewall 224 that provides an inner perimeter surface 226 facing the detent body 202. The detent body 202 is located with respect to the sidewall 224 such that the radial protrusion 218 abuts and is gently compressed against the inner perimeter surface 226. Rotation of the detent body 202 about the bell crank axis of rotation 138 causes the radial protrusion 218 to slide along the inner perimeter surface in a gently compressed state. The detent mechanism 200 further includes first and second engagement members that are peripherally spaced apart and located along the inner perimeter surface 226. In the illustrated example, the first and second engagement members include radial grooves 232, 234 into which the radial protrusion 218 is seated when the latching portion 122 is rotated into the latched position and alternately in the unlatched position, respectively. In particular, the radial grooves 232, 234 are located along the inner perimeter surface 226 and relative to the radial protrusion 218 on the detent body 202 so that the radial protrusion 218 seats in the respective radial grooves 232, 234 when the latching portion 122 is rotated into the latched and unlatched positions, respectively. The radial grooves 232, 234 are relatively rigid with respect to the relatively flexible radial protrusion 218 on the radially outer band 212. Rotation of the detent body 202 such that the radial protrusion 218 becomes aligned with respective radial groove 232, 234 allows the gently compressed radial protrusion 218 to spring radially outwardly into a seated position in the respective radial groove 232, 234, wherein the detent body 202 is retained by a mechanical coupling force provided by the natural bias of the radially outer band 212 and its tendency to maintain its natural shape. Thus, to rotate the latching device 102 out of the latched position and alternately out of the unlatched position, it is necessary to apply a rotary force on the hex actuator arm 166 that is greater than a nominal rotary force less than the mechanical coupling force of the detent mechanism 200. In other words, the bell crank 130 is rotatable by applying a first rotary force on the hex actuator arm 166 and alternately by applying a greater, second rotary force on the hex actuator arm 166. The first rotary force being insufficient to overcome the mechanical coupling force applied by the detent mechanism 200, thus preventing rotation of the latching portion 122 out of the latched position and alternately out of the unlatched position; whereas the second rotary force is sufficient to overcome the mechanical coupling force, thus enabling rotation of the latching portion 122 out of the latched position and alternately out of the unlatched position. Rotation of the hex actuator arm 166 via the second rotary force separates the engagement member 218 on the detent body 202 from engagement with the respective first or second engagement member on the latch housing 124 so as to permit rotation of the bell crank 130 and latch arm 128 into and out of the latched and unlatched positions.

It will thus be understood that according to the illustrate embodiment, the detent mechanism 200, including the detent body 202, radial protrusion 218 and radial grooves 232, 234, automatically retains the rotational position of the latching device 102 in the latched position and alternately in the unlatched position until the installer applies a large enough rotational force on the hex actuator arm 166 to overcome the mechanical connection between the flexible radial protrusion 218 and the respective rigid radial groove 232, 234 so as to move the radial protrusion 218 out of the respective groove 232, 234 and permit rotation of the radial protrusion 218 along the length of the inner perimeter surface 226.

It will thus be seen that the present disclosure provides embodiments of cowlings for marine drives and latching assemblies for cowlings for marine drives that are robust and well-suited for extended periods of use and non-use in harsh marine environments. These embodiments provide robust solutions for attaching first and second cowl portions together that are relatively easy to operate compared to prior art. Further, the above-described detent mechanism 200 advantageously retains the latching device 102 in the latched and unlatched positions, preventing accidental unlatching of the device and holding the latch arm 128 out of the way during installation of the top cowl portion 24 onto the bottom cowl portion 26. The detent mechanism 200 advantageously provides a novel solution that allows the latching portion 122 to turn smoothly and easily between the latched and unlatched positions.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A latching assembly for a cowling on a marine drive, the latching assembly comprising:

a retainer portion adapted to be fixed to a first cowl portion and a latching portion adapted to be fixed to a second cowl portion, wherein the latching portion comprises a latch arm and a crank, the latch arm and crank being movable into and between a latched position in which the latch arm is latched to the retainer portion and an unlatched position in which the latch arm is unlatched from the retainer portion, wherein movement of the latch arm and the crank together towards the latched position causes the latch arm to engage the retainer portion, and thereafter wherein further movement of the crank relative to the latch arm causes the latch arm to latch to the retainer portion, and wherein movement of the crank away from the latched position causes the latch arm to unlatch from the retainer portion, and thereafter wherein further movement of the crank relative to the latch arm causes the latch arm to separate from the retainer portion, and a detent mechanism that mechanically retains the latch arm and the crank in the latched position and alternately in the unlatched position.

2. The latching assembly according to claim 1, further comprising an actuator arm connected to the crank, wherein movement of the actuator arm causes said movement of the latch arm and the crank.

3. The latching assembly according to claim 2, wherein the crank is rotatable by applying a first rotary force on the actuator arm and alternately by applying a greater, second rotary force on the actuator arm, wherein the first rotary force is insufficient to overcome a mechanical coupling force applied by the detent mechanism, thus preventing movement of the latching portion out of the latched position and alternately out of the unlatched position, and wherein the second rotary force is sufficient to overcome the mechanical coupling force, thus enabling movement of the latching portion out of the latched position and alternately out of the unlatched position.

4. The latching assembly according to claim 2, wherein the detent mechanism comprises a detent body that moves with the actuator arm.

5. The latching assembly according to claim 2, wherein the detent mechanism rotates along a common axis with the actuator arm.

6. The latching assembly according to claim 2, wherein the detent mechanism comprises a detent body coupled to the actuator arm such that movement of the actuator arm causes movement of the detent body.

7. The latching assembly according to claim 2, wherein the latching portion comprises a latch housing configured to be fixed to the second cowl portion, and wherein the detent mechanism comprises an engagement member on the latch housing and an engagement member on the detent body that is configured to engage with the engagement member on the latch housing, and wherein movement of the actuator arm via the second rotary force separates the engagement member on the detent body from engagement with the engagement member on the latch housing so as to permit movement of the crank and the latch arm into and out of the latched and unlatched positions.

8. The latching assembly according to claim 7, wherein the latch housing comprises an inner perimeter surface and wherein the engagement member on the latch housing is located on the inner perimeter surface.

9. The latching assembly according to claim 8, wherein the detent body comprises an outer perimeter surface and wherein the engagement member on the detent body is located on the outer perimeter surface.

10. The latching assembly according to claim 9, wherein a first one of the engagement member on the latch housing and the engagement member on the detent body is flexible so as to permit, upon application of the second rotary force, rotary movement of the first one of the engagement member on the detent body and the engagement member on the latch housing relative to a second one of the engagement member on the latch housing and the engagement member on the detent body.

11. The latching assembly according to claim 10, wherein the second one of the engagement member on the latch housing and the engagement member on the detent body is rigid.

12. The latching assembly according to claim 9, wherein the detent body comprises a central hub and a radially outer band, and wherein a gap is defined between the central hub and the radially outer band and facilitates flexing of the radially outer band towards and away from the central hub.

13. The latching assembly according to claim 12, wherein the outer perimeter surface and the engagement member on the detent body are located along the radially outer band.

14. The latching assembly according to claim 13, wherein the engagement member on the detent body comprises a radial protrusion and wherein the engagement member on the latch housing comprises a radial groove into which the radial protrusion is seated so as to retain the latching portion in one of the latched position and the unlatched position with the mechanical coupling force.

15. The latching assembly according to claim 7, wherein the engagement member on the latch housing is one of first and second engagement members on the latch housing that are peripherally spaced apart, and wherein the engagement on the detent body is configured to engage with the first engagement member on the latch housing to retain the latching portion in the latched position, and alternately to engage with the second engagement member on the latch housing to retain the latching portion in the unlatched position.

16. The latching assembly according to claim 15, wherein the engagement member on the detent body is a radial protrusion and wherein the first and second engagement members on the latch housing are radial grooves into which the radial protrusion is seated when the latching portion is moved into the latched position and alternately in the unlatched position, respectively.

17. A cowling for a marine drive, the cowling comprising:

first and second cowl portions;

a latching device which couples the first and second cowl portions together in a closed cowl position, the latching device comprising a retainer portion configured to be fixed to the first cowl portion and a latching portion configured to be fixed to the second cowl portion, wherein the latching portion comprises a latch arm and a crank, the latch arm and crank being rotatable into and between a latched position in which the latch arm is latched to the retainer portion and an unlatched position in which the latch arm is unlatched from the retainer portion, wherein movement of the latch arm and the crank together towards the latched position causes the latch arm to engage the retainer portion, and thereafter wherein further movement of the crank relative to the latch arm causes the latch arm to latch to the retainer portion, and wherein movement of the crank away from the latched position causes the latch arm to unlatch from the retainer portion, and thereafter wherein further movement of the crank relative to the latch arm causes the latch arm to separate from the retainer portion; and a bolted connection which is spaced apart from the latching device and that fixes the first and second cowling portions together, the bolted connection being located on an opposite side of the cowling with respect to the latching device.

18. The cowling according to claim 17, wherein the bolted connection comprises a first mounting bracket fixed to a first one of the first and second cowl portions, a second mounting bracket fixed to a second one of the first and second cowl portions, and a bolt that extends through the first mounting bracket and into fixed engagement with the second mounting bracket.

19. The cowling according to claim 18, wherein the second mounting bracket comprises a receiving tray and wherein the first mounting bracket comprises a pedestal that seats within the receiving tray when the first and second cowl portions are aligned and brought together.

20. The cowling according to claim 17, wherein the latching device comprises an actuator shaft that extends through the cowling such that the latching device is operable from outside the cowling in a closed cowl position via a tool.

21. A cowling for a marine drive, the cowling comprising a retainer portion adapted to be fixed to an interior of a first cowl portion and a latching portion adapted to be fixed to an interior of a second cowl portion, wherein the latching portion comprises a latch arm which is movable into and between a latched position in which the latch arm is latched to the retainer portion and an unlatched position in which the latch arm is unlatched from the retainer portion, and further wherein the latching portion is movable into and between the latched position and the unlatched position from outside the cowling.

22. The cowling according to claim 21, wherein the latching portion is operable from outside the cowling via a tool.

23. The cowling according to claim 21, further comprising an actuator shaft which extends through the cowling and is operable from outside the cowling via a tool.

24. The cowling according to claim 23, wherein the actuator shaft is rotatable via the tool, which rotates the latching arm into and between the latched position and the unlatched position.

25. A cowling for a marine drive, the cowling comprising a retainer portion adapted to be fixed to an interior of a first cowl portion and a latching portion adapted to be fixed to an interior of a second cowl portion, wherein the latching portion comprises a latch arm which is movable into and between a latched position in which the latch arm is latched to the retainer portion and an unlatched position in which the latch arm is unlatched from the retainer portion, and further wherein the latching portion is movable into and between the latched position and the unlatched position from outside the cowling, wherein the latching portion comprises a crank, the latch arm and crank being movable into and between the latched position and the unlatched position, wherein movement of the latch arm and the crank together towards the latched position causes the latch arm to engage the retainer portion, and thereafter wherein further movement of the crank relative to the latch arm causes the latch arm to latch to the retainer portion, and wherein movement of the crank away from the latched position causes the latch arm to unlatch from the retainer portion, and thereafter wherein further movement of the crank relative to the latch arm causes the latch arm to separate from the retainer portion.

26. A cowling for a marine drive, the cowling comprising:

first and second cowl portions;

a fixed connection that fixes the first and second cowling portions together;

an access door providing access to the fixed connection;

a retainer portion fixed to an interior of the first cowl portion and a latching portion fixed to an interior of a second cowl portion, the retainer portion and latching portion being located on an opposite side of the cowling with respect to the fixed connection, wherein the latching portion comprises a latch arm which is movable into and between a latched position in which the latch arm is latched to the retainer portion and an unlatched position in which the latch arm is unlatched from the retainer portion, and further wherein the latching portion is movable into and between the latched position and the unlatched position from outside the cowling.

* * * * *